US006127784A

United States Patent [19]

Grossman et al.

[11] Patent Number: 6,127,784

[45] Date of Patent: Oct. 3, 2000

[54] LED DRIVING CIRCUITRY WITH VARIABLE LOAD TO CONTROL OUTPUT LIGHT INTENSITY OF AN LED

[75] Inventors: Hyman Grossman, Lambertville; John Adinolfi, Milltown, both of N.J.

[73] Assignee: Dialight Corporation, Manasquan, N.J.

[21] Appl. No.: 09/144,097

[22] Filed: Aug. 31, 1998

[51] Int. Cl.[7] ..... G05F 1/00

[52] U.S. Cl. ..... 315/159; 315/112; 315/117; 315/158; 315/307

[58] Field of Search ..... 315/50, 112, 117, 315/118, 224, 225, 291, 307, 151, 159, 158; 363/89, 80

[56] References Cited

U.S. PATENT DOCUMENTS

| | | | |
|---|---|---|---|
| 3,705,316 | 12/1972 | Burrous et al. | 307/311 |
| 4,463,284 | 7/1984 | Tamura et al. | 315/151 |
| 5,229,870 | 7/1993 | Inoguchi | 358/475 |
| 5,406,172 | 4/1995 | Bennett | 315/112 |
| 5,623,139 | 4/1997 | Sliski | 250/205 |
| 5,661,645 | 8/1997 | Hochstein | 363/89 |
| 5,783,909 | 7/1998 | Hochstein | 315/159 |
| 5,834,908 | 11/1998 | Boland et al. | 315/307 |

FOREIGN PATENT DOCUMENTS 63-178221 7/1988 Japan .

OTHER PUBLICATIONS

"Temperature Compensation Circuit for Constant LED Intensity" Application Brief 1–012; Hewlett Packard.

"Digital Feedback Light–Emitting Diode Control" by D.C. Thomas, Jr. and W.O. Tyndall, Jr. IBM Technical Disclosure Bulletin vol. 16 No. 8 Jan. 1974, pp. 2598–2600.

*Primary Examiner*—Don Wong
*Assistant Examiner*—Wilson Lee
*Attorney, Agent, or Firm*—Oblon, Spivak, McClelland, Maier & Neustadt, P.C.

[57] ABSTRACT

Circuitry for driving an LED array and a lamp including such circuitry. A fixed current source outputs a fixed current to an LED array. A variable load is provided in parallel to the LED array to also receive an output from the fixed current power supply. The variable load senses a condition affecting a luminous output of the LED array and varies an impedance based on this sensed condition. This variable load may typically include a thermistor or a photodetector. As the impedance of the variable load changes, current diverted from the LED to the variable load changes. Thereby, current supplied to the LED array, and thereby the intensity LED, can be controlled based on the impedance changing element in the variable load.

10 Claims, 1 Drawing Sheet

LED DRIVING CIRCUITRY WITH VARIABLE LOAD TO CONTROL OUTPUT LIGHT INTENSITY OF AN LED

BACKGROUND OF THE INVENTION

1. Field of the Invention

The present invention is directed to an LED lamp and a driving circuit to drive an LED array. More particularly, the present invention is directed to an LED lamp and a driving circuit which can drive an LED array with a compensation for conditions which change luminous output of the LED array. This invention can find particular application where the LED array is utilized in a device such as a traffic signal or another indicating signal.

2. Discussion of the Background

The use of LED arrays in indicating devices, such as traffic signals, is known. One drawback with using LEDs in an indicator such as a traffic signal is that luminous output of an LED degrades with both time and increasing temperature. For red LEDs degradation with respect to temperature will typically result in a loss of approximately one percent of intensity of the LED with every one degree centigrade increase in temperature. Conversely, as temperature decreases, intensity of light output by an LED increases. Moreover, LEDs gradually degrade over time, and thus become dimmer as they get older.

One known system senses a temperature at the LED or senses a light output at the LED, and utilizes the sensed temperature or sensed light output as a feedback to a power supply. Such a system is disclosed in U.S. Pat. No. 5,783,909 to Hochstein. This patent discloses (1) sensing either temperature at an LED or intensity output of an LED, (2) feeding back the sensed temperature or intensity to a power supply, and (3) then increasing or decreasing an average current output by the power supply based on any increase or decrease in temperature at the LED or any increase or decrease in the light output of the LED.

One drawback with such a system as disclosed in Hochstein is that such a system may not operate properly at low temperatures. As a specific example, a traffic signal is normally switched on and off by solid state relays. These relays may have a minimum current below which the relays cannot operate reliably. Utilizing a feedback operation such as in the device of Hochstein results in the following problems during low temperature operation of the LED array.

Because of the feedback operation in the device of Hochstein, at a low temperature a small total current is supplied to drive an LED array since the LED array is very bright at the low temperature. The total current supplied to the LED array may as a result cause the current through the load switch to fall below the minimum current required for the solid state relays to properly operate. In traffic signals it is also desirable to reduce lamp intensities at low temperatures while maintaining an input current to be compatible with a lamp controller. The device of Hochstein does not address problems of controller compatability.

OBJECTS OF THE INVENTION

Accordingly, one object of the present invention is to provide novel drive circuitry for an LED array which can overcome the drawbacks in the background art.

A further and more specific object of the present invention is to provide a novel drive circuit for an LED array in which the current supplied to the LED array can be compensated for without the use of a feedback circuit.

SUMMARY OF THE INVENTION

In one embodiment the present invention achieves these objects by forming a variable load in parallel to an LED array to be driven. This variable load has the property that the current drawn by the variable load varies based on a sensed parameter—for example, based on the sensed temperature at the LED array or the sensed intensity of light output by the LED array. This variation in current absorbed by the variable load changes the amount of current provided to the LED array, to thereby control the luminous output of the LED array.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
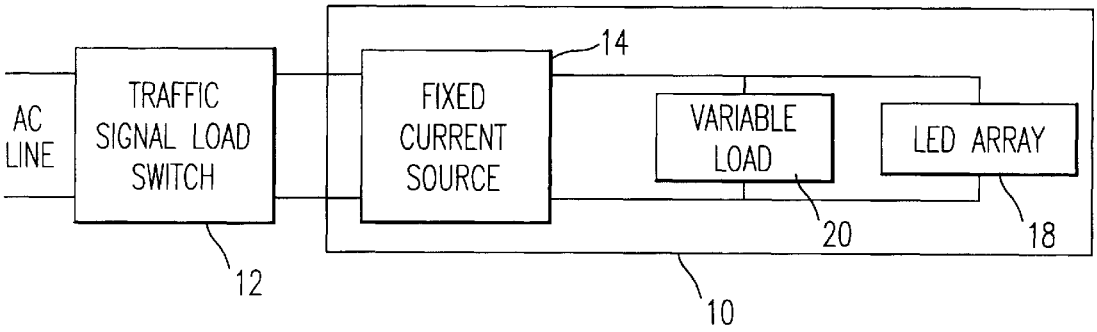
FIG. 1 shows one implementation of an LED lamp and driving circuit according to the present invention.

Referring now to the figures, wherein like reference numerals designate identical or corresponding parts throughout the several views, a pictorial example of the LED lamp and LED driving circuitry of the present invention is disclosed.

FIG. 1 shows an LED lamp 10 of the present invention connected to a traffic signal load switch 12, which in turn is connected to an AC power line. This disclosed embodiment in the present invention is directed to the LED lamp 10 being utilized in an LED traffic signal or similar LED indication signal. The LED lamp 10 includes a fixed current source 14 supplying power to both a variable load 20 and an LED array 18.

The fixed current source 14 can take the form of outputting either pulses or a direct current. If the fixed current source 14 outputs pulses, these pulses will be of a fixed amplitude and frequency. If the fixed current source 14 outputs a direct current, the direct current will be constant.

The fixed current source 14 is connected to the traffic signal load switch 12. The traffic signal load switch 12 provides power to one or more LED indication signals—i.e., to one or more LED lamps 10. The AC voltage from the AC line is thereby delivered through the traffic signal load switch 12 to the fixed current source 14 of the LED lamp 10.

The variable load 20 and the LED array 18 are arranged in parallel, and thereby any current absorbed by the variable load 20 is diverted from the LED array 18. Consequently, by varying the impedance of the variable load 20, the current passing through the LED array 18 is varied, and as a result the intensity of light output by the LED array 18 is varied.

This variable load 20 includes at least one element which senses a condition which affects the output light intensity of the LED array 18. For example, this variable load 20 can include either a thermistor circuit or a photodetector, provided that the thermistor or photodetector is configured to provide a variable impedance load. In one embodiment, this variable load 20 includes a thermistor circuit which has a variable impedance based on temperature. As a temperature increases, the resistance of the thermistor decreases, and this results in an increase in the impedance of the variable load 20, as discussed in further detail below. As a result, more current is diverted to the LED array 18. Thus, as the temperature at LED array 18 increases, the current supplied to the LED array 18 increases to maintain the luminous intensity of the LED array 18. A similar operation can be affected if the variable load 20 includes a photodetector as a variable impedance element which monitors light output by the LED array 18.

The above-identified operations can be summarized as follows. As temperature at LED array 18 increases or light output by LED array 18 decreases, the impedance of the variable load 20 increases. Thereby, more current from the fixed current source 14 is diverted to the LED array 18 so that the current passing through the LED array 18 increases, and as a result the illuminance of the LED array 18 increases. Thereby, any loss of illumination in the LED array 18 which results from an increase in temperature is compensated for. When a photodiode is used in the critical parameter sensor 28, any loss of intensity due to aging of the LED array 18 is compensated for as well.

Figure 2:
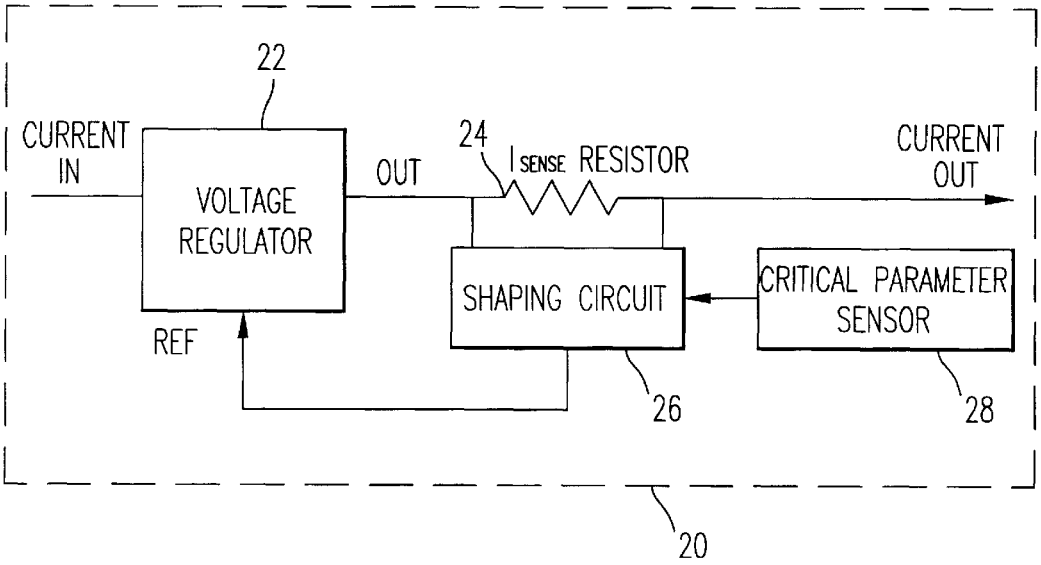
FIG. 2 shows a detailed description of a variable load of FIG. 1.

FIG. 2 shows a detailed explanation of the structure of the variable load 20.

As shown in FIG. 2, the variable load 20 includes a voltage regulator 22. The voltage regulator 22 may typically be a 3-terminal voltage regulator—for example model number LM 317 manufactured by National Semiconductor among others, or an equivalent voltage regulator. An output from the fixed current source 14 is supplied to the voltage regulator 22 as the "current in", and it is also supplied to the LED array 18 as shown in FIG. 1. The variable load 20 also includes a sense resistor 24 at an output of the voltage regulator 22. Formed across the sense resistor 24 is a shaping circuit 26. A critical parameter sensor 28 provides an input to the shaping circuit 26. The critical parameter sensor 28 can be a thermistor or a photodetector with variable impedance as discussed above. The output of the shaping circuit 26 is then fed back to the voltage regulator 22.

The elements forming the shaping circuit 26 are used to model characteristics of the critical parameter sensor 28 as discussed further below. The voltage regulator 22 is configured in this embodiment to form a linear current regulator. It is well known that a linear current regulator can be made from a commonly available 3-terminal voltage regulator 22 such as noted above. Such a voltage regulator forms a linear current regulator by placing the low value current sense resistor 24 in series with the output of the voltage regulator 22 and feeding back a voltage developed across the sense resistor 24 to a reference terminal REF of the voltage regulator 22. In the embodiment shown in FIG. 2 the shaping circuit 26 is used to moderate this feedback. The shaping circuit 26 is formed of active and passive circuitry as necessary to vary the signal presented to the REF terminal of the voltage regulator 22. As the voltage generated or impedance of the critical parameter sensor 28 changes, the reference voltage applied to the REF terminal of the voltage regulator 22 will vary.

The actual active and passive components forming shaping circuit 26 will vary based on the other components in LED lamp 10 and desired characteristics for LED lamp 10. However, the shaping circuit 26 should perform certain functions. First, the shaping circuit 26 should be constructed to compensate for the non-linear response of the LED array 18 to temperature and any non-linear properties of a thermistor or photodetector as the critical parameter sensor 28. As noted above, an LED may have a response to temperature of losing approximately 1% of light output per degree centigrade, which is a non-linear response, and a thermistor has a similar non-linear response. The shaping circuit 26 should select the active and passive components therein to address this non-linear quality of the LED array 18 and the critical parameter sensor 28.

Further, in the context of temperature compensation the shaping circuit 26 is constructed to provide a low stop to ensure that the variable load 20 always absorbs a certain current to ensure proper operation of the LED array 18. As noted above, if the current supplied to an LED falls below a certain level, the performance of the LED becomes unpredictable. This is a drawback in the background art which utilizes a feedback such that at low temperatures the current provided to an LED can drop to such a low level as to cause erratic illumination of the LED. Further, at low temperatures a current generated may be too low to switch the solid state on and off relays controlling a traffic signal. For this reason, the shaping circuit 26 should include a resistance in parallel with the critical parameter sensor 28 so that the reference voltage provided to the REF terminal of the voltage regulator 22 does not fall below a predetermined level. This ensures that the impedance of the variable load 20 does not drop too low and that the variable load 20 does not absorb too great a current at this low stop value.

In the circuit of FIG. 2, in the example that the critical parameter sensor 28 includes a thermistor, the operation is as follows. At a low temperature, the impedance of the thermistor of the critical parameter sensor 28 will be very high. However, as noted above the shaping circuit 26 includes a resistance in parallel with the thermistor of the critical parameter sensor 28 such that even if the critical parameter sensor 28 has an extremely high impedance, current still flows through the shaping circuit 26 to the REF terminal of the voltage regulator 22. This ensures that the voltage input to the reference terminal REF of the voltage regulator 22 still maintains a minimum value, so that the "current out" is not too high. This results in the variable load 20 maintaining an overall minimum impedance—i.e., the overall impedance of the variable circuit 20 does not fall below a predetermined level. This results in a minimum current always passing through the LED array 18. If the shaping circuit 26 is not appropriately configured with a low stop as discussed above, then the impedance of the variable load 20 may drop to too low a level. In that case, too much current will be diverted from the LED array 18. As noted above, if the LED array 18 does not receive an adequate driving current, illumination of the LED array becomes unpredictable.

Conversely, under very high temperature conditions the impedance of the thermistor in the critical parameter sensor 28 becomes very low. The voltage then input to the reference terminal REF of the voltage regulator 22 becomes very high, and as a result the "current out" is restricted. Thus, the variable load 20 in this high temperature operation takes on a very high impedance. This ensures that more current is diverted from the fixed current source 14 to the LED array 18 to increase the current passing through the LED array 18, to compensate for any temperature induced losses in intensity of light output by the LED array 18. No high stop structure is required in the present invention since even if the variable load 20 has an infinite resistance, this will only result in the LED array 18 receiving all of the current output from the fixed current source 14. The fixed current source 14 then should be selected to output a fixed current which if totally applied to the LED array 18 does not damage the LED array 18.

The above discussion has focused on an example in which the critical parameter sensor 28 is a thermistor. Similar operations as noted above also are effectuated if the critical parameter sensor 28 is a photosensor which has a variable impedance based on a detected light output.

If the critical parameter sensor 28 is a thermistor, this critical parameter sensor 28 should be placed closed enough to the LED array 18 to determine the temperature at the LED array 18. If the critical parameter sensor 28 is a photodetector, this photodetector should be placed near the LED array 18 to receive an indication of light output by the LED array 18. Further, if the critical parameter sensor 28 is a photodetector, the photodetector should be appropriately shielded from ambient light so that the photodetector only detects the intensity of light output by the LED array 18.

Also, the present invention can be applied to any driving circuit for any number of LEDs and arrays of LED, and it is not limited to driving one LED array.

Obviously, numerous modifications and variations of the present invention are possible in light of the above teachings. It is therefore to be understood that within the scope of the appended claims, the present invention may be practiced otherwise than as specifically described herein.

We claim:

1. Apparatus for indicating signals comprising:

(a) an LED array;

(b) a fixed current source which, in use, outputs a fixed current; and (c) a variable load electrically connected in parallel to the LED array, said variable load including a parameter sensor which has a variable impedance based on a condition affecting luminous output of the LED array, said LED array and said variable load both receiving, in parallel electrically, said fixed current output of said fixed current source.

2. The driving circuit according to claim 1, wherein:

(a) said the parameter sensor is a thermistor, and (b) the condition is the temperature at the LED array.

3. The driving circuit according to claim 1, wherein:

(a) said parameter sensor is a photosensor, and (b) the condition is an intensity of light output of the LED array.

4. The driving circuit according to claim 1, wherein said variable load further includes a shaping circuit having a resistance in parallel to said parameter sensor.

5. The driving circuit according to claim 4, wherein said variable load further includes a voltage regulator which, in use, receives the fixed current from said fixed current source and receives an output of said shaping circuit as a feedback reference voltage.

6. Apparatus for indicating signals comprising:

(a) an LED array;

(b) means for supplying a fixed current; and (c) means for varying an impedance, including a parameter sensor, in parallel electrically to the LED array based on a condition affecting luminous output of the LED array, said LED array and said means for varying an impedance both receiving, in parallel electrically, said fixed current output of said means for supplying a fixed current.

7. The driving circuit according to claim 6, wherein:

(a) said means for varying an impedance includes a thermistor, and (b) the condition is the temperature at the LED array.

8. The driving circuit according to claim 6, wherein:

(a) said means for varying an impedance includes a photosensor, and (b) said condition is the intensity of light output of the LED array.

9. The driving circuit according to claim 6, wherein said means for varying an impedance includes a shaping circuit.

10. The driving circuit according to claim 9, wherein said means for varying an impedance further includes a voltage regulator which, in use, receives the fixed current from the means for supplying a fixed current and receives an output of said shaping circuit as a feedback reference voltage.

* * * * *